US005448844A

United States Patent [19]

Miller, Jr. et al.

[11] Patent Number: 5,448,844

[45] Date of Patent: Sep. 12, 1995

[54] CHANGE PANEL MOUNTING DEVICE

[75] Inventors: Donald J. Miller, Jr., Belleville, Ill.; Keith Harbour, Florissant, Mo.

[73] Assignee: Paul Flum Ideas, Inc., St. Louis, Mo.

[21] Appl. No.: 134,387

[22] Filed: Oct. 12, 1993

[51] Int. Cl.[6] ..... G09F 7/00

[52] U.S. Cl. ..... 40/611; 40/306; 40/312

[58] Field of Search ..... 40/306, 312, 649, 660, 40/607, 611, 489, 575, 618; 248/912

[56] References Cited

U.S. PATENT DOCUMENTS

| | | | |
|---|---|---|---|
| 1,468,198 | 9/1923 | Dunn | 40/306 X |
| 1,921,202 | 8/1933 | Mungen | 40/611 X |
| 2,294,068 | 8/1942 | Budington | 40/611 X |
| 3,713,237 | 1/1973 | Thomson et al. | 40/607 X |
| 4,300,299 | 11/1981 | Batky et al. | 40/607 |

*Primary Examiner*—Kenneth J. Dorner
*Assistant Examiner*—Cassandra Davis
*Attorney, Agent, or Firm*—Haverstock, Garrett & Roberts

[57] ABSTRACT

An improved construction for mounting one or more changeable display panels in overlaying relationship to the outer surface of a product merchandising display unit or other supporting structure, the mounting construction including spaced opposed channel members and spaced opposed guide members positioned at predetermined locations on the outer surface of the display unit so as to cooperatively engage at least a portion of the respective top, bottom, and side edge portions of the display panel for holding the same in proper orientation on the display unit, the opposed channel members being constructed and dimensioned to provide additional maneuvering space therewithin so as to enable the opposed top and bottom edge portions of the display panel to be aligned and positioned for insertion therewithin, and at least one of the channel members including a step formed therein to facilitate the maneuvering of the display panel within the channel member preparatory to engaging and capturing both the top and bottom edge portions thereof with the respective channel members.

15 Claims, 5 Drawing Sheets

CHANGE PANEL MOUNTING DEVICE

The present invention relates generally to means for mounting and holding removable or changeable panel members and placards containing advertising and graphic images on product merchandising display devices and the like and, more particularly, to improved mounting means which can securely hold such changeable panel members in position on a display or other device and provide a finished, permanent looking appearance, yet still enable the panel members to be quickly and easily changed as desired.

BACKGROUND OF THE INVENTION

Changeable panels containing graphic images and advertising messages are used in association with many different types of merchandising display devices in supermarkets, convenience stores and other locations for marketing a wide variety of goods. Such changeable panels are typically relatively thin, flexible planar members made from a plastic or paper material, having a rectangular or other shape, and can include graphic images or advertising on one or both opposite sides thereof. Such planar changeable panels, better known as graphic or advertising change panels or, more simply, as change panels, are often mounted over all or a portion of the outer surface of a display unit such as portable displays used for merchandising items purchased by consumers on impulse, such as chilled soft-drinks and juices, candy, cigarettes, and other items. Such product merchandising display units are often placed at point-of-sale locations and at other high consumer traffic locations to merchandise one or more varieties of such products at the same time and also to display and sell different products at different times. In this regard, it is important to be able to mount more than one change panel on the outside of the merchandising units to identify or advertise the various goods therein. The change panels are used to make the display units more attractive and eye-catching, and it is particularly important in this regard to be able to frequently change and update the advertising messages and graphic images displayed thereon to reflect the specific goods sold therein and to maintain consumer interest and appeal. It is also desirable to be able to change the graphic images and advertising on such units to correspond with changing advertising campaigns as seen by consumers on television and in other mass media. In this regard, a plurality of such panels are often supplied in kit form for use with display and merchandising units as part of advertising campaigns and other marketing efforts.

In light of the above-discussed applications and uses for graphic and advertising change panels, a need has been identified for mounting means which enable such graphic and advertising panels to be quickly and easily changed by persons such as in-store supermarket and convenience store personnel without the use of tools, adhesives, and other fastening means which can be complicated, time consuming and not very effective, and also without requiring disassembly and reassembly of the display or merchandising units. Such mounting means should enable the panels to be securely and ruggedly mounted to withstand use in high traffic sales locations and provide a clean, finished appearance when installed. It is particularly desirable in this regard that mounting means for such panels blend in with the overall appearance of the unit while concealing the edges of the panels and while preventing the panels or portions thereof from becoming detached or separated from the display or merchandising unit when bumped by shoppers and the like or otherwise contacted or handled. The mounting means should also be adaptable for use with product merchandising and display devices of a wide variety of shapes and sizes and with change panels of different shapes and sizes.

SUMMARY OF THE INVENTION

The present invention meets the above-identified needs and requirements for mounting graphic and advertising change panels on product merchandising display units and other devices and the like and teaches the construction and operation of several embodiments of an improved change panel mounting means providing secure permanent looking attachment without looseness or exposed panel edges, while at the same time enabling the panels to be quickly and easily installed and removed without the use of tools and the like and without requiring disassembly of the units. The present mounting means are adaptable for use with a wide variety of merchandising and display units of different sizes and shapes, including rectangular and triangular shaped units, cylindrical and other shaped units, and any number of the present mounting means can be used for mounting one or more change panels on the outer surface of a unit. The present mounting means can also take advantage of the flexibility and resilient characteristics of a change panel member to conform the panel to the shape of a particular unit to provide more secure attachment to the unit. For instance, the present mounting means can be used for mounting one or more change panels around the curved outer surface of cylindrical or barrel shaped product merchandising devices used for displaying chilled beverages such as soft-drinks, juices and the like at point-of-sale locations in supermarkets and convenience stores. The present mounting means can hold and conform the change panel or panels to the outer curved surface of the unit, and the resiliency of the change panels can add to this holding capability. Furthermore, the present mounting means are adaptable to be retrofitted into existing display and merchandising units and can also be incorporated into new display and merchandising unit constructions as desired.

The present mounting means securely hold and contain a change panel member in position on a merchandising display unit by providing a plurality of channel, slot or groove means for cooperatively receiving the edge portions of the change panel member. Importantly, in several embodiments, the present mounting means include step means associated with at least one of the channel or slot means associated with the present invention, which step means engage one edge portion of the change panel and enable fast and easy installation and removal of such change panel without requiring tools, disassembly and reassembly of either the mounting means or the product merchandising display unit, and without requiring the use of adhesives or other gripping or fastening means commonly employed by known panel mounting arrangements. Also, the present step means enable the change panels to be held more securely in position on the unit, particularly, a cylindrical or barrel type unit. In this regard, the preferred step arrangement for use on a cylindrical type display unit includes a double step arrangement whereby installation of a change panel is facilitated by enabling insertion of one edge of the panel into the associated channel or slot past the first step so as to engage the second step, this enabling one to easily position and align one or more opposite edge portions of the panel for insertion into an opposing channel or channels. The panel can then be easily, slidably moved into the opposing channel or channels and thereafter, or at the same time, engaged with the first step means to hold and lock the panel securely in position in both of the opposing channels or slots. In essence, the present step means allows one to drop the edge portion of the panel down to a lower level, namely, the second step, so as to allow the opposite edge portion thereof to clear the opposing channel or channels so that the panel can then be insertably positioned within the opposing channel or channels by moving or raising the panel to a higher level, namely, the first step. This first step holds the panel in its final position. The present double step arrangement provides the necessary maneuvering room to accomplish this task as will be hereinafter more fully explained. Alternate panel mounting arrangements for use on a cynlindrical type display unit utilizing a single step arrangement are also disclosed herein.

The remaining edges of the change panel are preferably cooperatively received and contained in additional guide channels or slots which are also provided. The additional guide channels or slots are located and positioned so as to extend along at least a portion of the length of the change panel between the above-described opposing channels and serve as means to guide and direct the sliding movement of the panel between the opposing channels to facilitate alignment and engagement both with the channels and with the step means. As an alternative, any remaining edges of a panel can be held and contained using other means such as with spaced clips, tabs or other members, but this is not preferred.

When locked in position on a merchandising display unit using the present mounting means, the edges of a change panel are securely held in place in their corresponding channels or slots so as to contain and prevent excessive movement of the panel in any direction. This containment also prevents the edges of the panel from becoming loose when the unit is roughly handled or transported, or is bumped or otherwise contacted by shoppers, shopping carts and the like during use. The edges of the panel furthermore are concealed in their respective channels, providing the desired finished, permanent looking appearance. To unlock the change panel, the edge of the panel is merely disengaged from the step means and the panel again slidably moved further into one of the opposed channels past the first step means thereby allowing the opposite edge portion of the panel to clear the opposed channel for easy withdrawal therefrom. The panel can then be removed from the unit in any suitable manner such as by slidably moving it along the guide channels in the opposite direction out and away from the mounting means, or by flexing or bending the panel to remove it from the unit.

Another important feature of the present invention is its versatility in that it can be used in association with a wide variety of product merchandising display units and other devices. For example, the respective channels, slots or grooves and the associated step means of the present mounting means can be formed on any suitable member such as on an existing base, frame or other portion of a particular display unit or, alternatively, they can be provided as separate members which can be mounted on a unit as desired using any suitable means such as adhesives or mechanical fastening means or the like. The various channel and step means are also adaptable to be formed in any desired shape such as in a rectangular, triangular, arcuate or other shape so as to correspond and conform with the outer shape of a wide variety of merchandising display devices presently in use and, in this regard, the flexibility and resiliency of the change panels themselves can facilitate engagement with the present mounting means.

Still other embodiments of the present mounting means are also disclosed herein. Although these additional embodiments do not incorporate the present step means into their construction, they still provide more than adequate means for both securely holding and allowing easy removability and changeability of such panel members and, as such, these additional embodiments also present an improvement over the known panel mounting means. These additional embodiments are more fully explained in the detailed description of the present invention set forth below.

Regardless of which embodiment of the present panel mounting means is utilized, all of the present mounting mens are simple and economical to manufacture and install thereby making them ideal for use with relatively inexpensive or disposable product merchandising display units for seasonal merchandise and the like; they all afford improved capabilities over the known prior art mounting arrangements such as easy panel changeability, retrofit capability and low manufacturing cost; they all allow panels to conform to the shape of the particular unit to which they are installed; and they all provide a secure means for holding such panels in proper position on the particular display unit by capturing such change panels in some fashion of all sides.

OBJECTS OF THE INVENTION

It is therefore a principal object of the present invention to provide improved means for mounting advertising and graphic change panels on a variety of product merchandising and display units.

Another object is to teach the construction and operation of several embodiments of a panel mounting arrangement wherein each individual graphic change panel associate therewith can be easily and quickly installed, removed and changed to reflect current sales and product information.

Another object is to provide mounting means for graphic change panels which enable quick and easy changeability of such panels without requiring disassembly and reassembly of a merchandising display or other unit, and without requiring the use of tools, adhesives and the like.

Another object is to provide change panel mounting means which provide secure attachment and a permanent looking appearance when installed.

Another object is to provide change panel mounting means adaptable for use with a wide variety of different product merchandising and display devices including with cylindrical shaped merchandising units for placement at point-of-sale and other locations for selling chilled soft drinks, fruit juices and the like.

Another object is to provide change panel mounting means adaptable for use with a wide variety of change panels having different sizes and shapes.

Another object is to teach the construction and operation of several embodiments a panel mounting system wherein any number of such change panels can be incorporated into such system, each panel associated therewith being easily and quickly changeable to reflect new or different advertising information or other indicia.

Another object is to provide mounting means for advertising and graphic change panels which are simple and economical to make and use and which can be incorporated into both existing and new merchandising display unit constructions.

These and other objects and advantages of the present invention will become apparent to those skilled in the art after considering the following detailed specification in conjunction with the accompanying drawings wherein:

DETAILED DESCRIPTION OF THE PREFERRED EMBODIMENTS

For illustrative purposes only, the present means for mounting graphic and advertising change panels on product merchandising display devices are described and disclosed with respect to a cylindrically shaped product merchandising unit typically used for selling chilled beverages and the like in supermarkets and convenience stores at point-of-sale and other locations. It is anticipated and recognized that the present mounting means may be used in association with merchandising display devices which are fashioned into a variety of sizes and shapes as previously explained without departing from the teachings and practice of the present invention.

Figure 1:
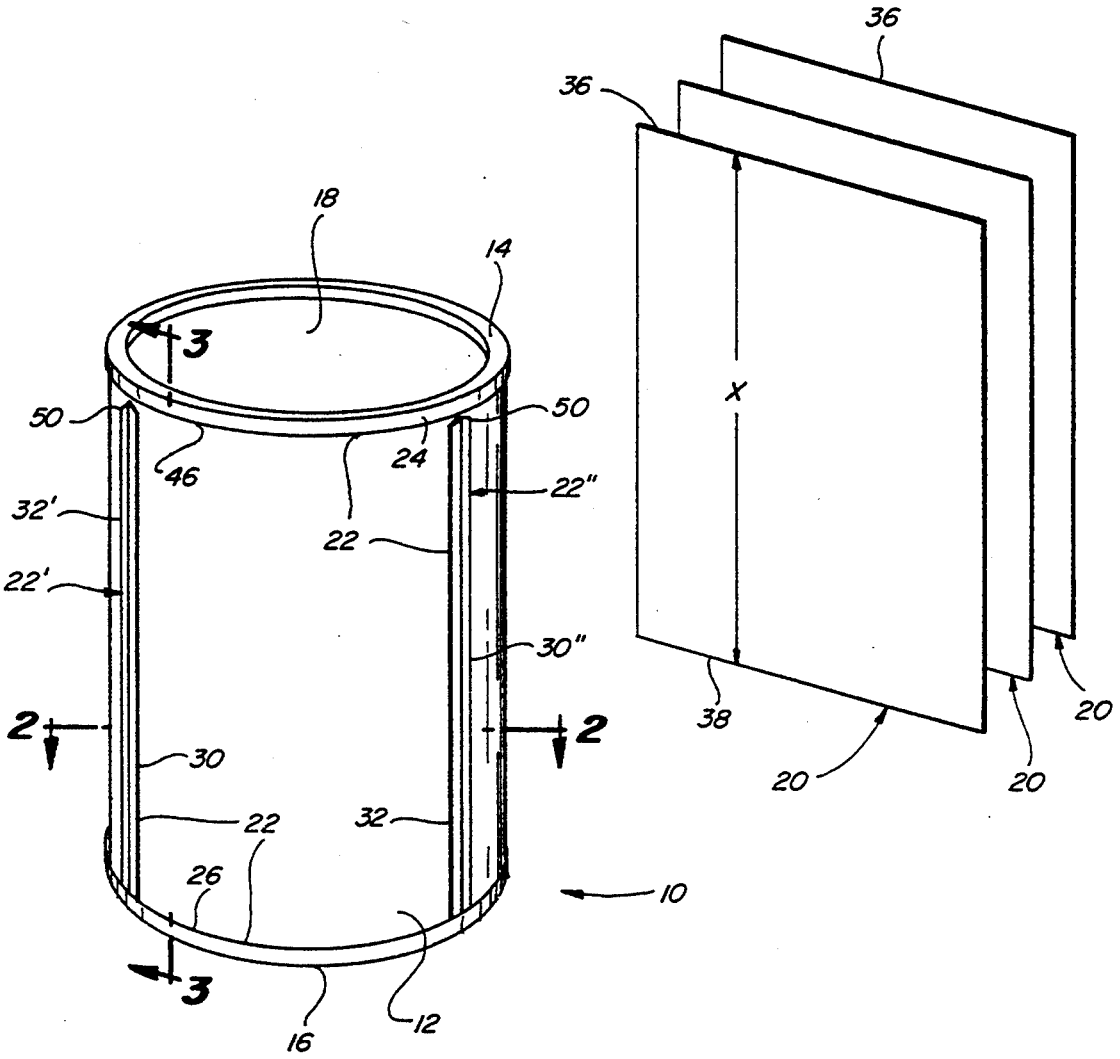
FIG. 1 is a perspective view of a typical product merchandising device for displaying chilled products including means associated therewith constructed according to the teachings of one embodiment of the present invention for mounting a plurality of advertising or graphic change panels around the outer surface of the device, and a plurality of change panels for mounting on the merchandising device.

Referring to the drawings more particularly by reference numbers wherein like numerals refer to like parts, number 10 in FIG. 1 identifies a product merchandising device utilizing the present mounting means. The product merchandising device 10 includes a cylindrical shaped outer surface portion 12 extending between opposed top and bottom end portions 14 and 16. The top end portion 14 is open and forms a cavity or recessed tub portion 18, the tub portion 18 being adapted for receiving and holding a plurality of beverage containers such as bottles or cans of soft drinks or juices.

FIG. 1 also shows a plurality of advertising or graphic change panels 20 for mounting around the outer surface 12 of the product merchandising device 10. Each of the change panels 20 is a planar member of rectangular shape, although other shapes will likewise work, which can be fabricated from any desired material such as plastic or paper. The respective panels 20 can each include advertising messages or graphic images (not shown) on one or both of the opposite surfaces thereof and the panels can be mounted on the device 10 with either surface facing outwardly for display purposes. Each of the change panels 20 is preferably a flexible member and each is sufficiently resilient so as to return to a substantially planar condition when flexed or bent and released, which capability can facilitate its use as discussed below. As with the product merchandising device 10, it is anticipated and recognized that the change panels 20 may likewise be fashioned for use with the present mounting means into a variety of sizes and shapes as previously explained without departing from the teachings and practice of the present invention.

Figure 2:
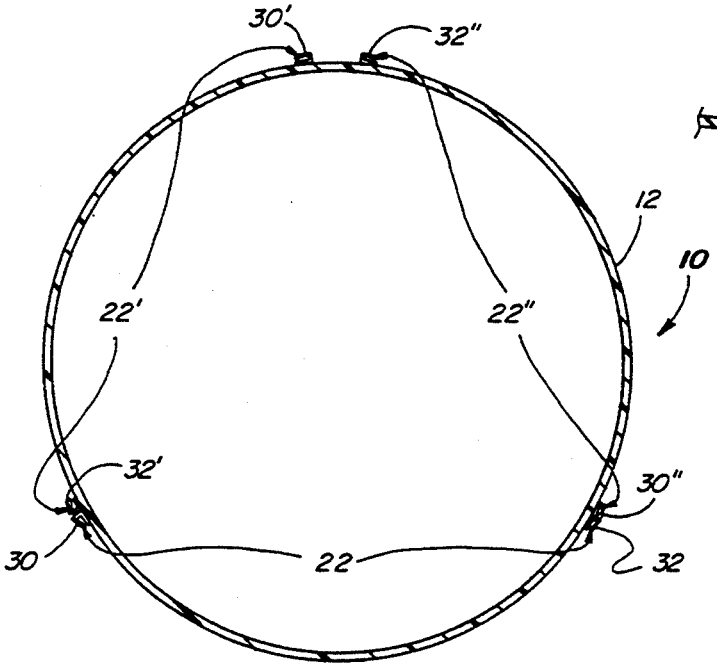
FIG. 2 is an enlarged cross-sectional view taken along line 2—2 of FIG. 1.

The present panel mounting means illustrated in FIG. 1 represents a preferred embodiment of the present invention specifically designed for use with cylindrical shaped display units. Although the arrangement of FIG. 1 illustrates use of the present means for mounting up to three change panels in any order in side-by-side relationship around substantially the entire circumference of the cylindrical outer surface 12, it is recognized that the present means can be fashioned to hold any plurality of such panels depending upon the respective sizes of both the display unit and the invdividual panel members 20 as well as the particlular application involved. The present mounting means is associated with each of the change panels 20 in FIG. 1 and each mounting arrangement is separately identified as 22, 22' and 22'' as best shown in FIGS. 1 and 2. The respective mounting means 22, 22' and 22'' are substantially identical in construction and operation to one another and each includes a common first receiving channel or slot member 24 located adjacent the top end portion 14 of the display device 10, and a common second receiving channel or slot member 26 located adjacent the bottom end portion 16 of the display device 10 in spaced, opposed relation to the first channel member 24. The channel member 24 includes a channel, slot, groove or other means 34 (FIG. 3) for cooperatively receiving and engaging one edge portion of each of the respective panels 20 such as the upper edge portions thereof, while the channel member 26 includes similar channel or slot means 40 (FIG. 3) located in opposed relationship to those of the first channel member 24 for receiving the opposite edge portions of the respective panels 20. Step means 28 (FIG. 3) are associated with the second channel member 26 and extend around the circumference thereof. As will be hereinafter explained, the step means 28 are cooperatively engageable with an edge portion of each of the change panels 20 cooperatively received within the second channel member 26 to facilitate installation of such change panels and to hold, support and secure the panels in both of the respective channel members 24 and 26.

The present mounting means further include guide channel members such as the guide members 30 and 32, 30' and 32', and 30'' and 32'' respectively, each pair of associated guide members extending axially or vertically along at least a portion of the length of the cylindrical outer surface 12 of the device 10 between the opposed channel members 24 and 26 as best shown in FIG. 2. The guide members 30 and 32, 30' and 32', and 30'' and 32'' serve to cooperatively receive and engage the remaining opposed side edge portions of the change panels 20 as can be best seen in FIGS. 1, 2 and 4. In some situations, particularly when the present mounting means are being used on a cylindrical type unit, it is generally preferred that the guide members, such as the members 30 and 32, extend substantially along the full vertical length of the display unit as shown in FIG. 1. This prevents the panels 20 from being shaken loose or otherwise separated from any one of its mounting means during use as previously explained. On the other hand, it is recognized that guide members of any suitable length can likewise be used so long as they adequately hold and support the opposed side edge portions of the respective change panels 20 depending upon the particular use and application intended for the particular display unit involved. This means that each guide member 30 and 32 may include a plurality of small, spaced apart guide portions or tabs in sufficient number to adequately hold and support the side edge portions of the panel member. In this regard, it is also recognized and anticipated that each channel member 24 and 26 may likewise be formed by a plurality of spaced apart channel portions in sufficient number to likewise achieve their stated purpose and objective.

Figure 3:
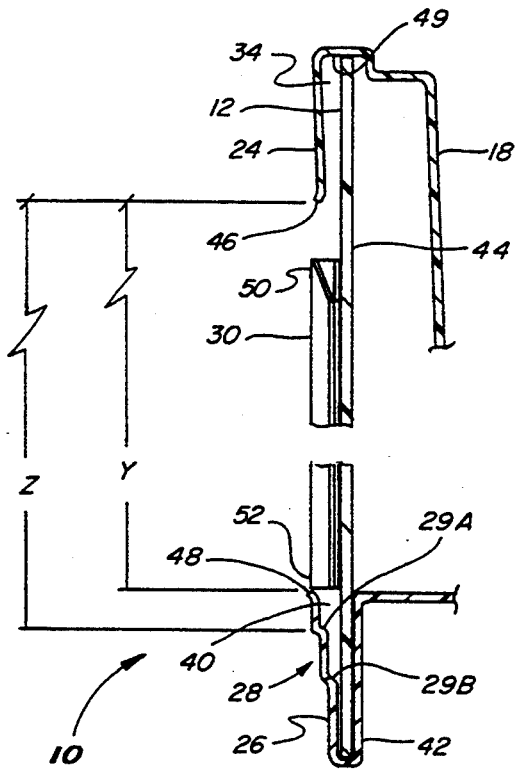
FIG. 3 is an enlarged fragmentary cross-sectional view taken along line 3—3 of FIG. 1 showing the constructional details of the merchandising device and the present mounting means attached thereto.

Referring to FIG. 3, the present mounting means will be explained more particularly with reference to the mounting means 22 illustrated in FIG. 1. The first receiving channel member 24 forms an annular shaped channel or slot portion 34 for cooperatively receiving one of the opposite edge portions 36 or 38 of a change panel member 20, the second receiving channel member 26 forming an opposing annular shaped channel or slot portion 40 adapted to receive the other edge portion of the panel member 20. For ease and economy of manufacture, the first channel member 24 can be made integral with the tub portion 18 of the particular display device 10 illustrated in FIG. 1, and the second channel member 26 can be made integral with the bottom or base portion 42 of such device. A cylindrical shaped body member 44 forms the outermost surface 12 of the display unit 10 and extends between the respective channel members 24 and 26 as illustrated in FIG. 3. In this particular arrangement, the opposite end portions of the body member 44 extend into the respective annular channel or slot portions 34 and 40. Insulating means such as the insulation material 45 illustrated in FIGS. 6 and 7 may be located between the body member 44 and the tub portion 18 to help maintain soft drink products and the like located therein cold.

Each of the change panel members 20 has a length dimension as measured between the longitudinal edge portions 36 and 38 thereof designated by the letter "X" as shown in FIG. 1. Referring again to FIG. 3, the distance between the closest respective edge portions 46 and 48 of the respective channel members 24 and 26 is designated by the letter "Y", which distance "Y" is designed so as to be sufficiently less than the overall length "X" of the panel members such that the respective opposite edges of a particular change panel member 20 can be simultaneously contained in both of the respective slots 34 and 40 of the channel members 24 and 26. Importantly, to enable easy insertion of a particular change panel member 20 into both of the respective channels 34 and 40 underneath the channel edges 46 and 48 without requiring removal of either or both of the members 24 and 26 or any other disassembly of the device 10, and without substantially flexing or bending the panel member 20 which can be difficult and which can make handling of the panel somewhat awkward, the channel 40 of the receiving channel member 26 is sufficiently deep as measured downwardly from the edge portion 48 to the bottom of such channel such that when one edge of a panel member is inserted relatively far into the channel 40, the opposite edge thereof will clear the opposite edge or rim portion 46 associated with the channel member 24. When in this position, with one edge portion of the panel 20 inserted into the channel 40, the change panel 20 importantly is conformed, at least somewhat, to the cylindrical outer surface 12 of the display unit 10 and the opposite edge portion thereof is positioned for easy alignment and insertion into the opposing annular shaped channel or slot 34. The panel 20 can be inserted into the channel 34 by pressing the panel against the surface 12 and slidably moving it in the direction towards the first channel member 24 and into the slot or channel 34. Once the panel member 20 is cooperatively received in both of the opposing channels 34 and 40, the panel can be moved or shifted such that the edge of the panel located in the channel 40 cooperatively engages the step means 28 associated with the channel member 26 as discussed below to maintain the panel in proper position in the respective channels. In this regard, the resiliency of the panel 20 acting to return the panel to a planar condition can be useful in engaging the panel with the step means.

The step means 28 preferably includes a first step 29A and a second step 29B, the steps 29A and 29B each providing a substantially continuous surface on the receiving channel member 26 which face substantially in the direction of the opposing receiving channel member 24. The step surface 29A is located at a distance designated by the letter "Z" from the opposed edge portion 46 of the channel member 24, which distance "Z" is less than the length "X" of the change panel members 20. The first step surface 29A is also spacedly related by some distance from the edge portion 48 of the associated channel member 26. This relationship between the panel length "X" and the distance "Z" is important as it enables a change panel member engaged with the first step 29A to be contained in both of the opposed channels 34 and 40.

Engagement of the change panel edge portion with the first step 29A can be achieved by any suitable means, such as by frictional contact between the panel and the step means. Additionally, one or both of the terminal edge portions of the channel members 24 and 26 can be biased somewhat radially inwardly towards the outer surface 12 of the body member 44 so as to engage the panel member and urge it into engagement with the step means. It is also possible to locate the first step means 29A a distance approximately equal to the length "X" of the change panel from the topmost inner surface 49 of the opposing slot or channel 34 such that a change panel member having one edge portion cooperatively received in the channel portion 34 and having its one edge portion in abutment with the surface 49 will be biased or urged longitudinally against the first step 29A. The second step surface 29B is provided to incorporate sufficient maneuvering room between the outer surface 12 of the body member 44 and the change panel 20 so that the bottom edge portion 38 of the panel member 20 can be moved to a lower position against the second step 29B so as to allow the top panel edge 36 to clear the rim or edge portion 46 of the upper receiving channel member 24 as previously described. As will be hereinafter explained, in some applications, depending upon the construction of the lower channel member 26 and the particular width of the space or channel 40 associated therewith, this second step 29B may not be necessary. It is also recognized and anticipated that the step means 29A and 29B may be formed by a plurality of aligned surfaces instead of a substantially continuous surface.

Figure 5:
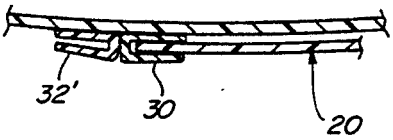
FIG. 5 is an enlarged fragmentary cross-sectional view taken along line 5—5 of FIG. 4 showing the cooperative engagement of the change panel with one of the guide channel members.
Figure 4:
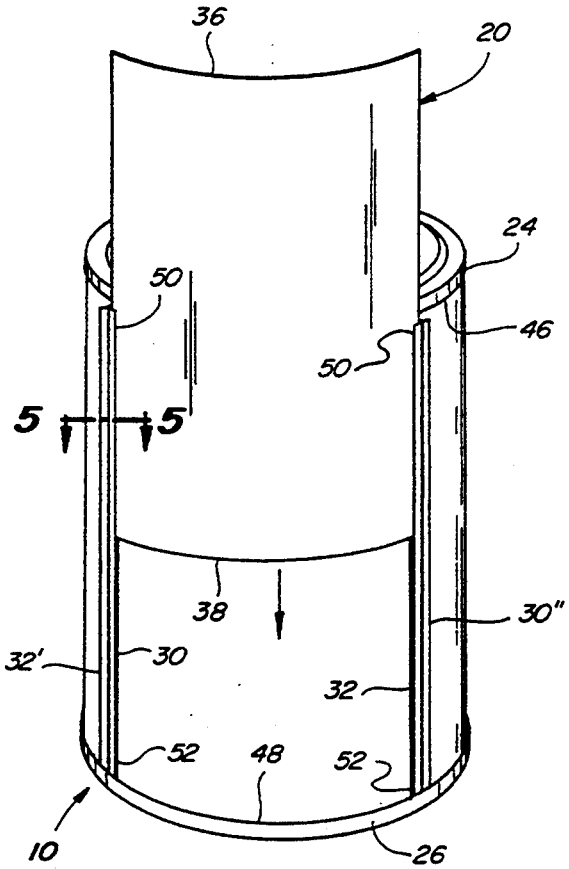
FIG. 4 is another perspective view of the merchandising device of FIG. 1 illustrating a first step in the installation of a change panel thereon.

The guide members 30 and 32 extend axially or vertically along the outer surface 12 of the device 10 between the support members 24 and 26 as shown in FIGS. 1, 3, and 4. Each guide member 30 and 32 includes a first end portion 50 which is preferably located in spaced relationship to the edge portion 46 of the channel member 24 so as to form a slight space or gap therebetween as best shown in FIGS. 1 and 4. This arrangement enables the edge of the change panel member to be more easily inserted into the respective guide members. Each guide member also includes an opposite end portion 52 which is preferably located in relatively close proximity to the edge portions 48 of the channel member 26 to facilitate alignment and insertion of the change panel 20 into the lower channel or slot 40. The guide members 30 and 32 can be of any suitable shape capable of securing and holding the respective side edge portions of the change panel, the preferred construction comprising elongated members having a substantially U-shaped cross-section adapted for slidably receiving the side edges of the change panel member. The free end or leg portions of the U-shaped guide channel members 30 and 32 can also be biased towards one another, as more clearly shown by the construction of the guide member 32' illustrated in FIG. 5, to provide more secure containment and holding capability. This is likewise illustrated in FIG. 5 by the engagement of the change panel member 20 with the adjacent guide member 30. Still further, adjacent guide members associated with the respective mounting means 22, 22' and 22'' can comprise separate members mounted on the device 10 in back-to-back relation to each other as shown by the members 30 and 32' illustrated in FIG. 5 or, alternatively, adjacent guide members can be integrally formed into a single, unitary member, if desired.

Figure 6:
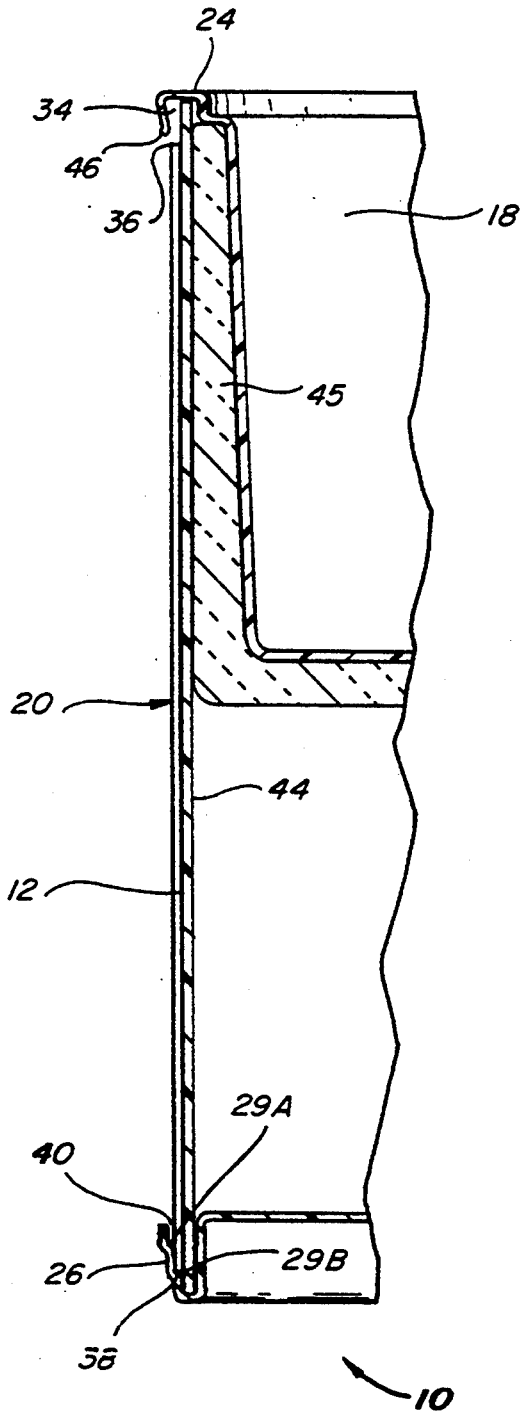
FIG. 6 is a fragmentary cross-sectional view of the merchandising device and the associated mounting means of FIG. 1, showing a further step in the installation of the change panel thereon.
Figure 7:
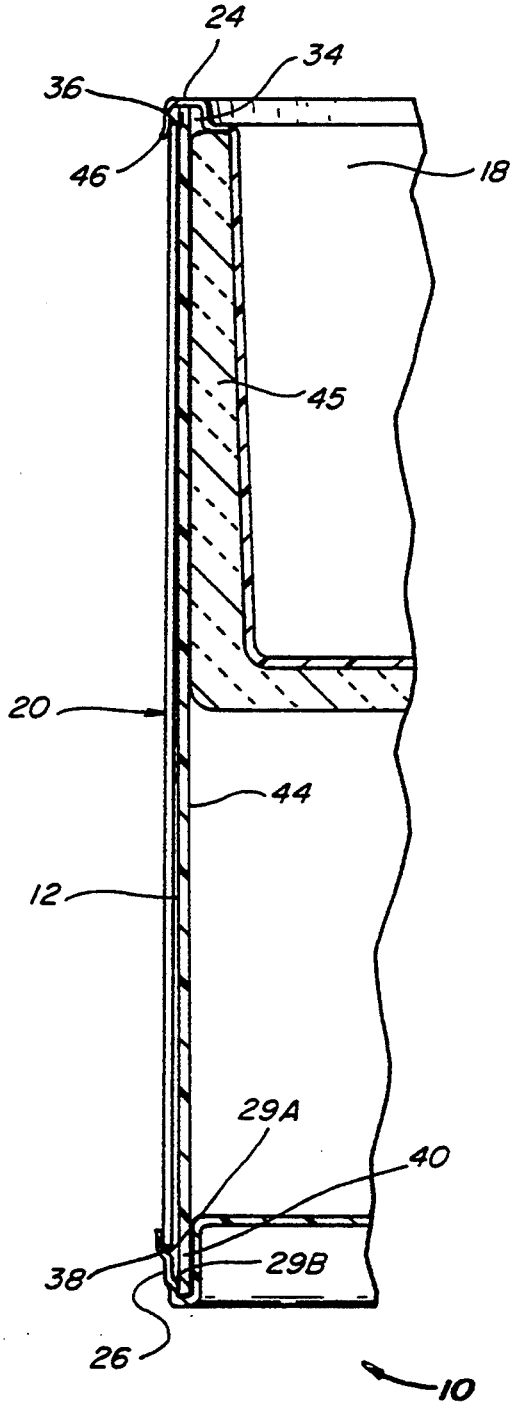
FIG. 7 another fragmentary cross-sectional view similar to FIG. 6 showing completed installation of the change panel.

Installation of a particular change panel using the present mounting means can be accomplished quickly and easily in the following manner. Referring to FIG. 4, one end portion of a change panel, such as the end portion 38 of panel 20, is first engaged with the respective guide members 30 and 32 adjacent the first or upper end portions 50 thereof. The change panel 20 is thereafter slidably moved along the respective guide members 30 and 32 towards the second or lower end portions 52 thereof until the panel edge portion 38 is inserted into the channel or slot 40 of the lower channel member 26. Once inserted within the channel 40, the edge portion 38 of the change panel is slidably moved past the first step 29A so as to come to rest upon the second step 29B as shown in FIG. 6. In this position, the opposite edge portion 36 of the change panel 20 is now clear of the edge or rim portion 46 of the opposing channel member 24 and is easily positionable against the outer surface of 12 of the body member 44 in alignment with the channel 34. The change panel 20 can then be slidably moved in the opposite direction along the guide members 30 and 32 so as to insert the opposite edge portion 36 into the channel 34. The change panel 20 can then be securely locked and maintained in this position by continuing to move the change panel 20 upwardly so as to engage the edge portion 38 thereof located in the channel 40 with the first step means 29A as shown in FIG. 7. As can be seen in FIG. 7, a small gap may exist between the lower portion of the change panel 20 and the outer surface 12 of the display unit in this position, however, this gap is negligible and may not extend completely around the entire width of the change panel between the respective guide members. In fact, the entire lower edge 38 of the change panel 20 need not be engaged with the step 29A along its entire length for secure attachment and some bowing of the panel is to be expected and may be beneficial. With the panel 20 so engaged, the display device 10 can be handled, transported, bumped and/or otherwise contacted without any of the respective edge portions of the change panel 20 becoming disengaged or dislodged from either the respective channel members 24 and 26 or the respective guide members 30 and 32. The remaining change panels 20 can be mounted onto the device 10 in the above-described fashion and all of the panels will have an overall appearance of being an integral, permanent looking part of the display unit 10.

Removal of the change panels 20 can likewise be accomplished with similar ease and quickness. To remove a change panel 20, a user first disengages the panel from the step means 29A. This can be easily accomplished by pressing the change panel against the outer surface 12 of the body member 44 adjacent the channel member 26, and then thereafter sliding the change panel downwardly further or deeper into the channel 40 past step means 29A so that the lower edge portion 38 of the panel 20 now rests upon step means 29B. The opposite edge portion 36 of change panel 20 is now clear of the upper channel 34 and the entire panel can now be slidably moved upwardly along the guide members 30 and 32 until completely removed therefrom. The space or gap between the end portions 50 of the guide members and the edge portion 46 of the channel member 24 facilitate this removal. Alternatively, once the panel member is removed from one of the upper or lower receiving channel members, the change panel 20 can be flexed or bent so as to remove it from the respective guide members 30 and 32, if so desired.

Figure 8:
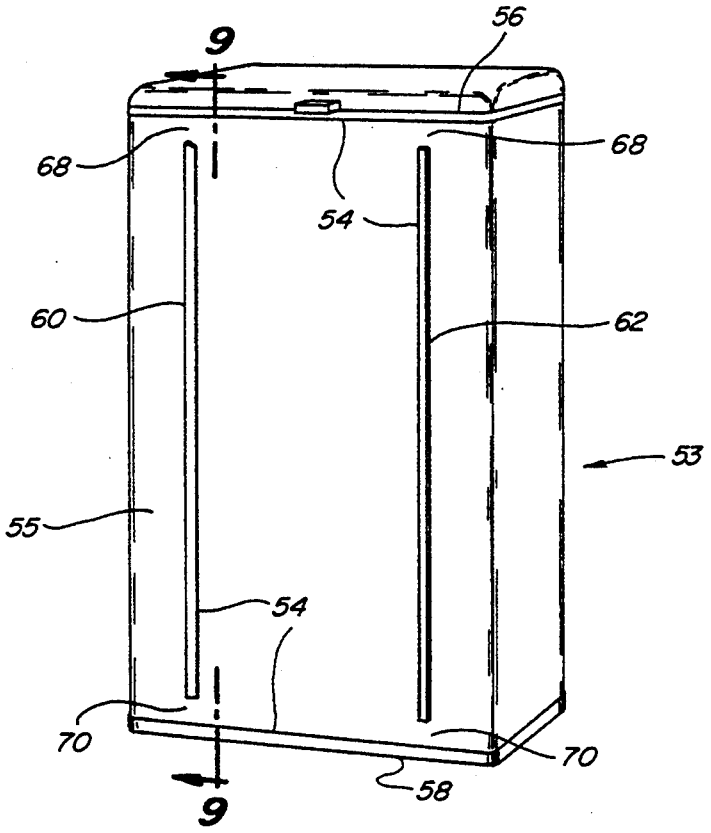
FIG. 8 is a perspective view of another product merchandising display construction utilizing another embodiment of the present change panel mounting means.
Figure 9:
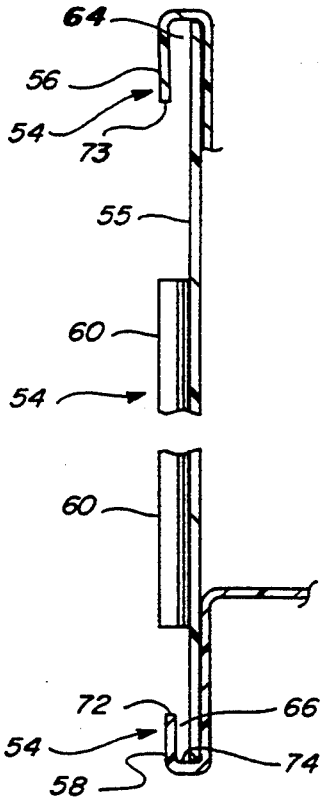
FIG. 9 is an enlarged fragmentary cross-sectional view taken along line 9—9 of FIG. 8.

FIG. 8 illustrates another embodiment of the present mounting means 54, the mounting means 54 being shown adaptable for use in conjunction with a rectangular type product display cooler 53 and including a pair of upper and lower channel members 56 and 58 and a pair of opposed side guide members 60 and 62. The channel members 56 and 58 are similar in overall construction to the channel members 24 and 26 and each extends horizontally across the respective upper and lower portions of the outer surface portion 55 of the display cooler 53 as shown in FIG. 8. Like the channel members 24 and 26, the channel members 56 and 58 each include a channel, slot, groove or other means 64 and 66 as best shown in FIG. 9 for cooperatively receiving and engaging one edge portion of any of the panel members 20 as previously explained with respect to embodiment 22 illustrated in FIGS. 1–7. However, unlike the construction of the channel member 26, the channel member 58 (FIG. 9) includes no step means.

Similarly, the guide members 60 and 62 are likewise substantially similar in shape and construction as compared to the construction of the guide members 30 and 32 as previously explained. Here again, however, unlike the guide members 30 and 32, the guide members 60 and 62 are shorter in overall length as compared to the members 30 and 32 (FIGS. 1 and 4) and define a greater space or gap 68 and 70 between their respective opposite end portions and the opposed channel members 56 and 58 as best illustrated in FIG. 8. This additional space or gap at the respective opposite end portions of the side guide members 60 and 62 is necessary for facilitating the mounting and removal of the respective change panels 20. Like the guide members 30 and 32, the guide membrs 60 and 62 serve to cooperatively receive and engage the remaining opposed side edge portions of the change panel 20 as previously explained.

Installation of a particular change panel into the mounting means 54 is accomplished as follows. In this particular arrangement, it is first necessary to rest and support the panel member 20 against the outer surface 55 of the display cooler 53 with the bottom edge portion of the panel member resting on the floor or other supporting surface. In this position, one side edge portion of the panel member 20 is maneuvered and positioned so as to be slidably inserted into one of the side guide members 60 or 62. Thereafter, the panel member 20 is flexed or bowed such that the opposite side edge portion thereof can also be slidably inserted into the other side guide member 60 or 62. The panel member 20 is now engaged with both side guide members 60 and 62 and has its bottom edge portion still resting on the floor or other supporting surface. Once this position is obtained, the upper edge portion of the panel member 20 is slidably moved upwardly into the channel or slot 64 a sufficient distance such that the bottom edge portion thereof clears the channel rim or edge portion 72 and is positioned thereabove. The panel member 20 can now be moved downwardly into the channel or slot 66 so as to rest on the lower inner surface 74 thereof. In this position, the upper and lower edge portions of the panel member 20 are engaged and captured within the respective channel members 56 and 58 and the side edge portions thereof are likewise captured and engaged in the side guide members 60 and 62. As previously explained, it is recognized that the overall length of the panel member 20 and the depth of the respective channel slots 64 and 66 must be such as to allow the panel member to be maneuvered up and down as explained above in order to accomplish capture and engagement with the respective channel members 56 and 58. In this regard, the distance between the terminal edge portion 72 and the bottom edge portion of the channel member 58 is less than the distance between the terminal edge portion 73 and the top edge portion of the channel member 56. This enables the panel member 20 to be maneuvered so as to rest on the lower inner surface 74 of channel member 58 and still remain captured by the upper channel member 56. This mounting means construction likewise captures the panel member 20 on all of its edge portions and securely holds the panel member 20 in proper position during use. As can be appreciated, the additional spaces or gaps 68 and 70 are likewise necessary to facilitate up and down movement of the panel member 20 to ultimately capture and lock the upper and lower portions thereof within the respective channel members 56 and 58. Removal of the change panel from the mounting means 54 is easily accomplished in reverse order.

Figure 10:
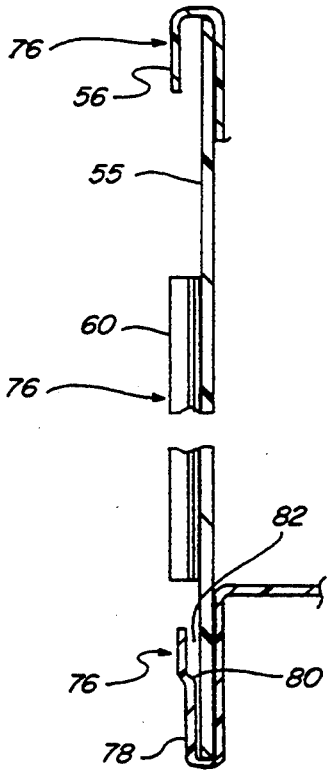
FIG. 10 is an enlarged fragmentary cross-sectional view similar to FIG. 9 showing still another embodiment of the present change panel mounting means.

Since the lower channel member 58 of the mounting means 54 does not include any step means, this embodiment is particularly adaptable for use in mounting change panels on relatively flat surfaces, although it can likewise be utilized in conjuction with a cylindrical surface. Because of the flexibility and resiliency of the panel members 20, it has been found, as previously explained, that some sort of step means associated with one of the opposed channel members such as with either one of the channel members 24 or 26 is generally preferred when the present mounting means is used on a cylindrical surface since use of such step means helps to retain the respective opposite edge portions of the panel member within the respective upper and lower channel members when such panel member is flexed or bent to conform to the cylindrical outer shape of a particular display unit or other supporting surface. With this in mind, the embodiment 76 in FIG. 10 represents a slight variation to the mounting means 54 (FIGS. 8 and 9) in that the lower channel member 78 includes a single step 80 which is specifically designed for use in association with cylindrical display units. In all other respects, the present mounting means 76 is substantially identical to the various components associated with the mounting means 54 previously explained. Positioning and locating the step means 80 is accomplished as previously explained taking into consideration the distances "X", "Y" and "Z" as previously explained with reference to FIG. 3. Use of the step means 80 in the channel member 78 sufficiently enlarges the channel or slot 82 located between the outer cooler surface 55 and the upper portion of the channel member 78 so as to enable the panel member 20 to flex or bow in conformity with a cylindrical surface. The step means 80 also provides all of the advantages previously explained with respect to the embodiment illustrated in FIGS. 1–7. The addition of step 80 allows the mounting means 54 to be likewise utilized in conjunction with a cylindrical or barrel shaped display unit.

Figure 11:
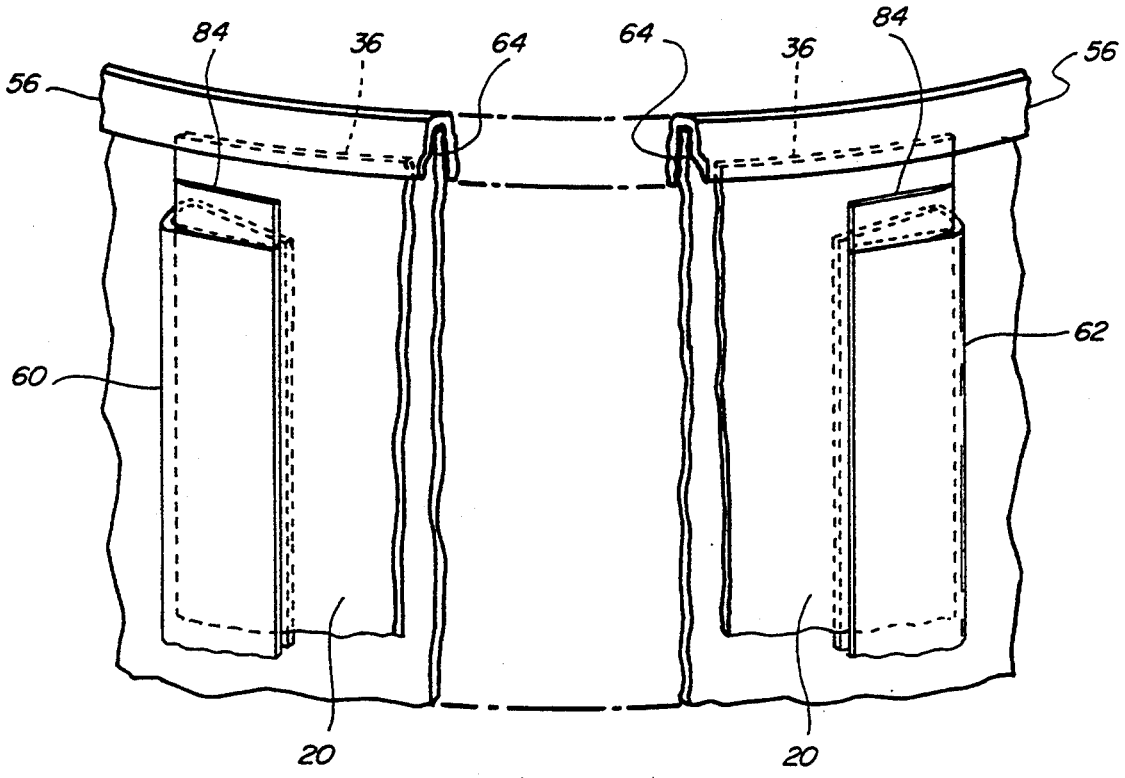
FIG. 11 is a fragmentary partial perspective view showing still a further embodiment of the present change panel mounting means.

FIG. 11 illustrates still another embodiment of the present mounting means wherein a pair of flange projections 84 are mounted in spaced relationship from the top edge portion 36 of a respective panel 20 adjacent the respective side edge portions of such panel as illustrated in FIG. 11. The opposed projections 84 are shaped and constructed so as to be insertable within the side guide members such as the members 60 and 62 and they are positioned and located relative to the top panel edge portion 36 such that when the panel member 20 is moved upwardly into engagement with the top channel member such as the channel member 56, the flange projections 84 exit the respective guide members 60 and 62 and rest upon the top end portions thereof. It is important that the flange projections 84 be positioned and located such that when they rest in abutting relationship on top of the respective end portions of the guide membrs 60 and 62, at least a portion of the upper panel edge portion 36 is engaged with and confined within the slot or groove 64 while, at the same time, the lower panel edge portion (not shown) is engaged with and confined within the slot or groove associated with the lower channel member 58.

With respect to this particular emodiment illustrated in FIG. 11, it is preferred that the panel member 20 be installed within the mounting means 54 by first engaging the side edge portions of such panel member with the side guide members 60 and 62 as previously explained with respect to FIGS. 8 and 9, although installation is also possible as explained with respect to FIG. 4. It is also important to note that use of the flange projections 84 in conjunction with any particular panel member 20 allows one to vary the overall length "X" of such panel member to some degree since, in this particular arrangement, the bottom panel edge portion 38 is not required to rest upon the lower inner surface 74 of the channel member 58. Since the flange projections 84 both support the panel member 20 vertically and allow the top edge portion thereof to remain in engagement with the upper channel member 56, secure attachment is achieved so long as a portion of the panel member 20 is slidably positioned and contained within the lower channel member 58 when the flange projections 84 are in their final operative position resting upon the top edge portions of the guide members 60 and 62. This embodiment, in essence, allows one to reduce the manufacturing tolerances associated with the fabrication of the panel members thereby again effectively reducing the overall cost involved.

To facilitate easy entry of the flange projections 84 into the respective guide members 60 and 62, the overall size and shape of the projections 84 can be controlled to achieve this purpose, and one or more edge portions of the projections 84 can be tapered or beveled as illustrated in FIG. 11 to facilitate such entry. Removal of a panel member utilizing the flange projections 84 is likewise accomplished in reverse order by slidably moving the panel member downwardly allowing the projection members 84 to again enter the respective guide member 60 and 62 so that the top edge portion 36 of such panel member clears the upper channel member 56. Depending upon the exact overall length "X" of the panel member 20, it may also be possible to remove the panel member by first slidably moving such panel member upwardly such that the lower panel edge portion clears the lower channel member 58. In either case, the panel member can be easily installed and removed in conformity with the objectives of the present invention.

Figure 12:
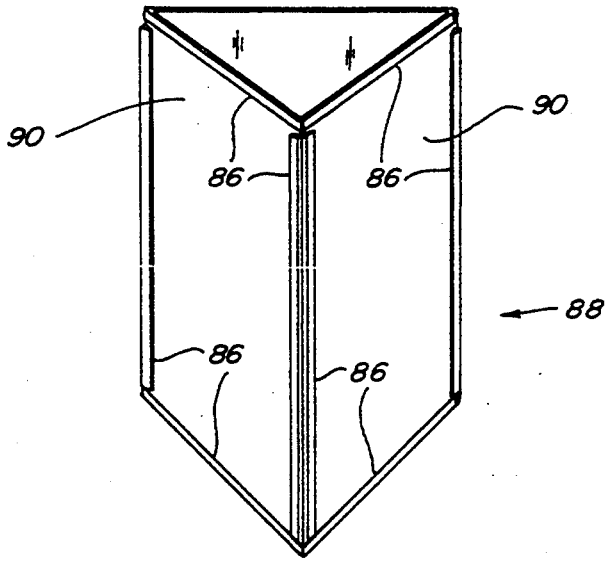
FIG. 12 is a perspective view of another product merchandising display construction showing mounting means according to the present invention associated therewith.

Although the various embodiments of the present invention have been shown and discussed in association with merchandising display units having primarily a cylindrical or rectangular shape, all of the embodiments of the present change panel mounting means can be used in association with product merchandising display units of many different shapes and sizes. For example, referring to FIG. 12, any of the various embodiments of the present mounting means is shown at 86 in association with the respective outer surfaces 90 of a triangularly shaped product merchandising device 88. The present mounting means can also be used in association with hexagonal, octagonal and other shaped units, to name a few. The present mounting means are furthermore adaptable to be used with change panels having a variety of different sizes and shapes, including hexagonal and octagonal shaped panels with equal utility.

Still further, the present mounting means can be incorporated onto a merchandising display device in any suitable manner. For example, the first and second opposed channel members of embodiments 22 and 76 discussed above can comprise separate members mounted on the particular merchandising unit adjacent the respective end portions thereof, or elsewhere as desired. The step means 28 or 80 can alternatively be associated with the other opposed channel member such as the channel member 24, or such means can be formed by a plurality of spaced surface segments or portions positioned for engaging the appropriate edge of the panel member at spaced locations, instead of being a continuous surface. The step means 28 or 80 can also be located on the opposite side of the associated channel or slot, although this is generally not preferred.

Thus there has been shown and described a novel means for removably mounting a display panel in overlaying relationship with the outer surface of a display unit or other supporting structure, which panel mounting means fulfill all of the objects and advantages sought therefor. Many changes, modifications, variations and other uses and applications of the present invention will, however, become apparent to those skilled in the art after considering this specification and the accompanying drawings. All such changes, modifications, variations and other uses and applications which do not depart from the spirit and the scope of the invention are deemed to be covered by the invention which is limited only by the claims which follow.

What is claimed is:

1. Means for mounting a display panel member having any plurality of opposed top and bottom edge portions and any plurality of opposed side edge portions in overlaying relationship to an outer surface of a support structure, said mounting means comprising first channel means positioned at a predetermined location on the outer surface of the support structure for cooperatively engaging at least a portion of at least one of said top edge portions of the panel member, second channel means positioned on the outer surface of the support structure in opposed relation to said first channel means for cooperatively engaging at least a portion of at least one of said bottom edge portions of the panel member, first guide means positioned at a predetermined location on the outer surface of the support structure for cooperatively engaging at least a portion of one of said opposed side edge positions of the panel member and second guide means positioned on the outer surface of the support structure in opposed relation to said first guide means for cooperatively engaging at least a portion of another of said positions opposed side edge of the panel member, said opposed channel means and said opposed guide means being capable of holding the panel member in overlaying relationship to the outer surface of the support structure when the panel member edge portions are maneuvered into engagement respectively therewith, said first and second channel means said first and second guide means being constructed and dimensioned so as to enable the edge portions of the panel member to be slidably positioned for insertion therewithin, at least one of said first and second channel means including step means formed therein, said step means being positioned and located so as to engage at least a portion of a panel member edge portion when the panel member edge portion is inserted within the channel means in which said step means are located for holding the panel member in an installed position, said channel means and guide means engaging and capturing the respective top, bottom, and side edge portions of the panel member when the panel member is in its installed position.

2. The mounting means defined in claim 1 wherein said step means includes a single, continuous surface.

3. The mounting means defined in claim 1 wherein said step means include a plurality of aligned surface portions.

4. The mounting means defined in claim 1 wherein said step means includes first and second step portions, said first and second step portions being constructed such that one of the edge portion of a panel member inserted into the channel means in which said step means are located is maneuverable past said first step portion into engagement with said second step portion during installation thereof, movement of one of the panel member edge portions into engagement with said second step portion enabling one of the opposed panel member edge portion to be aligned and positioned for insertion into said other opposed channel means.

5. The mounting means defined in claim 1 wherein each of said opposed guide means includes a plurality of spaced and aligned guide members.

6. The mounting means defined in claim 1 wherein each of said opposed guide means includes a plurality of spaced tab members.

7. The mounting means defined in claim 1 wherein at least one of said opposed guide means are positioned and located such that a space exists between said at least one the guide means and one of the opposed channel means.

8. The mounting means defined in claim 1 wherein said opposed channel means and opposed guide means have end portions and are positioned and located relative to each other such that a space exists between the respective opposite end portions of said opposed guide means and said respective opposed channel means.

9. The mounting means defined in claim 1 including a panel member having at least one flange projection positioned and located in a spaced relationship from a top edge portion thereof such that when the panel member is maneuvered into its installed position, at least a portion of at least one of the top edge portions of the panel member is engaged with the first channel means and said flange projection rests upon an end portion of said guide means.

10. The mounting means defined in claim 1 wherein a plurality of said mounting means are positioned and located on the outer surface of the support structure for mounting a plurality of the panel members thereon.

11. Panel mounting means for mounting a display panel member in overlaying relationship to an outer surface of a support structure wherein the display panel member includes of opposed top, bottom and side edge portions, the panel member being flexible so as to be capable of conforming to the outer surface of the support structure, said mounting means including at least two opposed channel members positioned at predetermined locations on the support structure for cooperatively engaging at least portions of the top and bottom edge portions of the panel member, at least two opposed guide members positioned at predetermined locations on the outer surface of the support structure for cooperatively engaging at least portions of the opposed side edge portions of the panel member, said opposed channel members and said opposed guide members including means for receiving and holding the respective top, bottom and side edge portions of the panel member when the panel member edge portions are engaged respectively therewith, the panel member adapted to be slidably movable within said guide means so as to enable the opposed top and bottom edge portions thereof to be aligned and positioned for insertion within said opposed channel members, said channel members and said guide members adapted to engage and capturing at least portions of the respective top, bottom and side edge portions of the panel member when the panel member edge portions are inserted therein, at least one of said channel members including step means formed therein, said step means being positioned and located so as to facilitate the maneuvering of the panel member within said one channel member preparatory to engaging and capturing the opposed top and bottom edge portions of the panel member within said channel members.

12. A merchandising display device comprising a body member having an outer surface portion extending by and between opposed top and bottom end portions thereof, a changeable display panel, and means for mounting said changeable display panel in overlaying relationship to the outer surface of said display device, said display panel having opposed top and bottom edge portions and opposed side edge portions, said mounting means including opposed channel means located adjacent the respective top and bottom end portions of said body member for receiving and holding the respective top and bottom edge portions of said display panel, opposed guide means positioned on the outer surface of said body member for cooperatively engaging at least portions of the side edge portions of said display panel, said display panel being slidably movable within said opposed guide means, one of said channel means including step means positioned and located therewithin, said step means enabling one edge portion of said changeable display panel to be maneuvered within said channel means so as to enable alignment and positioning of the opposite edge portion of said display panel for insertion into the other of said opposed channel means, the one edge portion of the display panel being engageable with said step means when the top and bottom edge portions of said display panel are each captured within said channel means.

13. The display device defined in claim 12 wherein said step means includes a single step portion dimensioned so as to engage the one edge portion of said display panel.

14. The display device defined in claim 12 wherein said step means includes first and second step portions, said first and second step portions being constructed such that the edge portion of said display panel is maneuverable past said first step portion into engagement with said second step portion during installation thereof, movement of said display panel edge portion into engagement with said second step portion enabling the opposite panel edge portion to be aligned and positioned for insertion into said other opposed channel means.

15. The display device defined in claim 12 wherein the outer surface portion of said body member is cylindrical in shape.

* * * * *

UNITED STATES PATENT AND TRADEMARK OFFICE

CERTIFICATE OF CORRECTION

PATENT NO. : 5,448,844

DATED : September 12, 1995

INVENTOR(S) : Donald J. Miller, Jr. and Keith Harbour

It is certified that error appears in the above-indentified patent and that said Letters Patent is hereby corrected as shown below:

Column 5, line 41, after "Fig. 7", insert --is--.

Column 15, line 15, "portion" should be --portions--.

Column 15, line 22, "portion" should be --portions--.

Column 15, line 33, after "one", insert --of--.

Column 15, line 57, delete "of".

Column 16, line 11, "capturing" should be --capture--.

Signed and Sealed this

Thirteenth Day of February, 1996

Bruce Lehman

*Attest:*

BRUCE LEHMAN

*Attesting Officer*

*Commissioner of Patents and Trademarks*